US005938086A

United States Patent [19]

Gross

[11] Patent Number: 5,938,086

[45] Date of Patent: Aug. 17, 1999

[54] CONTAINER AND CLOSURE WITH NON-RISING ROTATABLE HOUSING, DISPENSING VALVE, AND SEPARATE RELEASABLE INTERNAL SHIPPING SEAL

[75] Inventor: Richard A. Gross, Oconomowoc, Wis.

[73] Assignee: Aptargroup, Inc., Crystal Lake, Ill.

[21] Appl. No.: 09/186,967

[22] Filed: Nov. 5, 1998

[51] Int. Cl.[6] ..... B67D 3/00

[52] U.S. Cl. ..... 222/494; 222/506; 222/507; 222/525; 222/545; 222/542

[58] Field of Search ..... 222/490, 494, 222/506, 507, 509, 522, 523, 525, 545, 548, 547

[56] References Cited

U.S. PATENT DOCUMENTS

| | | | |
|---|---|---|---|
| 2,998,902 | 9/1961 | Thomas et al. . | |
| 3,123,259 | 3/1964 | Musel et al. . | |
| 3,149,755 | 9/1964 | Porter et al. . | |
| 3,204,836 | 9/1965 | Joffe . | |
| 3,207,375 | 9/1965 | Bereziat et al. . | |
| 3,221,952 | 12/1965 | De See . | |
| 3,260,423 | 7/1966 | Fillmore et al. . | |
| 3,669,323 | 6/1972 | Harker et al. . | |
| 3,887,116 | 6/1975 | Ishikawa et al. . | |
| 4,474,314 | 10/1984 | Roggenburg, Jr. . | |
| 4,506,809 | 3/1985 | Corsette . | |
| 4,561,570 | 12/1985 | Zulauf et al. . | |
| 4,807,786 | 2/1989 | Gueret . | |
| 4,817,831 | 4/1989 | Theisen . | |
| 4,941,598 | 7/1990 | Lambelet, Jr. et al. . | |
| 5,033,647 | 7/1991 | Smith et al. . | |
| 5,139,182 | 8/1992 | Appla . | |
| 5,161,718 | 11/1992 | Gueret . | |
| 5,325,999 | 7/1994 | Gueret . | |
| 5,431,305 | 7/1995 | Kaminski | 222/507 X |
| 5,680,969 | 10/1997 | Gross | 222/494 |
| 5,692,651 | 12/1997 | Fuchs . | |
| 5,713,493 | 2/1998 | Garibaldi | 222/507 X |

FOREIGN PATENT DOCUMENTS

| | | | |
|---|---|---|---|
| 296103 | 12/1988 | European Pat. Off. . | |
| 1350703 | 12/1963 | France | 222/507 |

*Primary Examiner*—Kevin P. Shaver
*Attorney, Agent, or Firm*—Rockey, Milnamow & Katz, Ltd.

[57] ABSTRACT

A dispensing system is provided for a container having an opening to the container interior. The dispensing system includes a closure with an elevator that is disposed within the container opening for movement between a fully elevated position and a fully lowered position while the elevator is restrained by the container from rotating. The elevator has a seat defining an inlet passage and has a thread. A rotatable housing is mounted on the container at the opening and has a thread engaged with the elevator thread. The housing has a dispensing passage and an occlusion member. The occlusion member sealingly engages the elevator seat and prevents flow through the elevator inlet passage when the elevator is in the fully elevated position. When the elevator is moved away from the fully elevated position by rotation of the housing, flow is permitted through the inlet passage and into the housing dispensing passage. A flexible dispensing valve is sealingly secured across the dispensing passage in the housing. The valve has a self-sealing slit which opens to permit flow therethrough in response to increased pressure on the side of the valve facing the interior of the container.

20 Claims, 9 Drawing Sheets

CONTAINER AND CLOSURE WITH NON-RISING ROTATABLE HOUSING, DISPENSING VALVE, AND SEPARATE RELEASABLE INTERNAL SHIPPING SEAL

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a container and closure system. The invention is particularly suitable for use with a squeeze-type container which can dispense product through a valve that opens when the container is squeezed and that automatically closes when the squeezing pressure is released.

BACKGROUND OF THE INVENTION AND TECHNICAL PROBLEMS POSED BY THE PRIOR ART

A variety of packages, including dispensing packages or containers, have been developed for food and drink products and for personal care products such as shampoo, lotions, etc., as well as for other fluid materials. One type of closure for these kinds of containers typically has a flexible, self-closing, slit-type dispensing valve mounted over the container opening. The valve has a slit or slits which define a normally closed orifice that opens to permit fluid flow therethrough in response to increased pressure within the container when the container is squeezed. The valve automatically closes to shut off fluid flow therethrough upon reduction of the increased pressure.

Closure designs have been proposed which incorporate such valves, and examples are illustrated in the U.S. Pat. No. 5,680,969. The closure disclosed in that patent has the advantage of not requiring a conventional, removable lid or hinged lid. Further, the closure includes a sealing system which includes a plug between the valve and a discharge aperture in the body of the closure below the valve. The closure can be manipulated to close the sealing system to prevent the valve from being exposed to any of the hydraulic pressures in the container until the container is ready for use. The container remains securely sealed below the valve during shipping and when it is packed for travel. Because the sealing system is internal and is not visible to the user, once the user has initially unsealed the container to permit operation of the valve, the user will be more likely to subsequently leave the container in the unsealed condition for more convenient dispensing by action of the self-closing valve alone.

While a package consisting of a container and the closure disclosed in the U.S. Pat. No. 5,680,969 functions exceptionally well and has desirable advantages, in some applications it would be desirable to provide an improved dispensing system that would require less operating height and that would more readily accommodate larger diameter containers.

Such an improved dispensing system should preferably not require a lid but should nevertheless function to provide at least some protection for the valve. Also, such an improved dispensing system should be able to effectively seal off the valve from contact with the container contents during shipping or when otherwise desired.

Additionally, it would be beneficial if the dispensing system components could be provided with an improved system for readily accommodating the assembly of the components during manufacture.

Also, it would be desirable if such an improved dispensing system could be provided with a design that would accommodate efficient, high quality, large volume manufacturing techniques with a reduced product reject rate.

Further, such an improved dispensing system should advantageously accommodate its use with a variety of container shapes.

The present invention provides an improved dispensing system which can accommodate designs having the above-discussed benefits and features.

BRIEF SUMMARY OF THE INVENTION

According to the present invention, a dispensing system is provided for a container which has an opening to the container interior. The system provides a leak-tight seal which is especially useful when the container is shipped or when the container is packed by a user for travel.

The invention is especially suitable for use with a pressure openable dispensing valve because a closure seal is disposed between the valve and the container contents. This prevents the valve from being exposed to any of the hydraulic pressures in the container until the container is ready for use. The container remains securely sealed during shipping and when it is packed for travel. Because the sealing system is internal and not visible to the user, the user, once having initially unsealed the container to permit operation of the valve, will be more likely to subsequently leave the container in the unsealed condition for more convenient dispensing by action of the self-closing valve alone.

The dispensing system of the present invention includes a container. The container has an opening to the container interior. The dispensing system also includes a closure. The closure includes an elevator, a rotatable housing, and a flexible dispensing valve. The elevator is disposed within the container opening. The elevator is restrained by the container from rotation, but is movable between a fully elevated position and a fully lowered position. The elevator has a seat defining an inlet passage, and the elevator has a thread.

The rotatable housing is mounted on the container at the container opening. The housing has a thread engaged with the elevator thread. The housing has a dispensing passage and an occlusion member that sealingly engages the elevator seat and prevents flow through the elevator inlet passage when the elevator is in the fully elevated position. Flow is permitted past the occlusion member when the elevator is moved away from the fully elevated position. This occurs when the housing is rotated to drive the elevator down.

The dispensing valve is sealingly secured across the dispensing passage of the housing. In the preferred embodiment, the dispensing valve has at least one self-sealing slit which opens to permit flow therethrough in response to increased pressure on the side of the valve facing the interior of the container.

When the closure housing is rotated to drive the elevator to the fully elevated position to close off the inlet passage, the valve is no longer exposed to the pressure within the interior of the container or to the contents therein. This may be characterized as a sealed shipping configuration.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 7 shows the components in a fully closed condition;

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, and the scope of the invention will be pointed out in the appended claims.

For ease of description, the dispensing system of this invention is described in various positions, and terms such as upper, lower, horizontal, etc., are used with reference to these positions. It will be understood, however, that the system components may be manufactured and stored in orientations other than the ones described.

Figure 1:
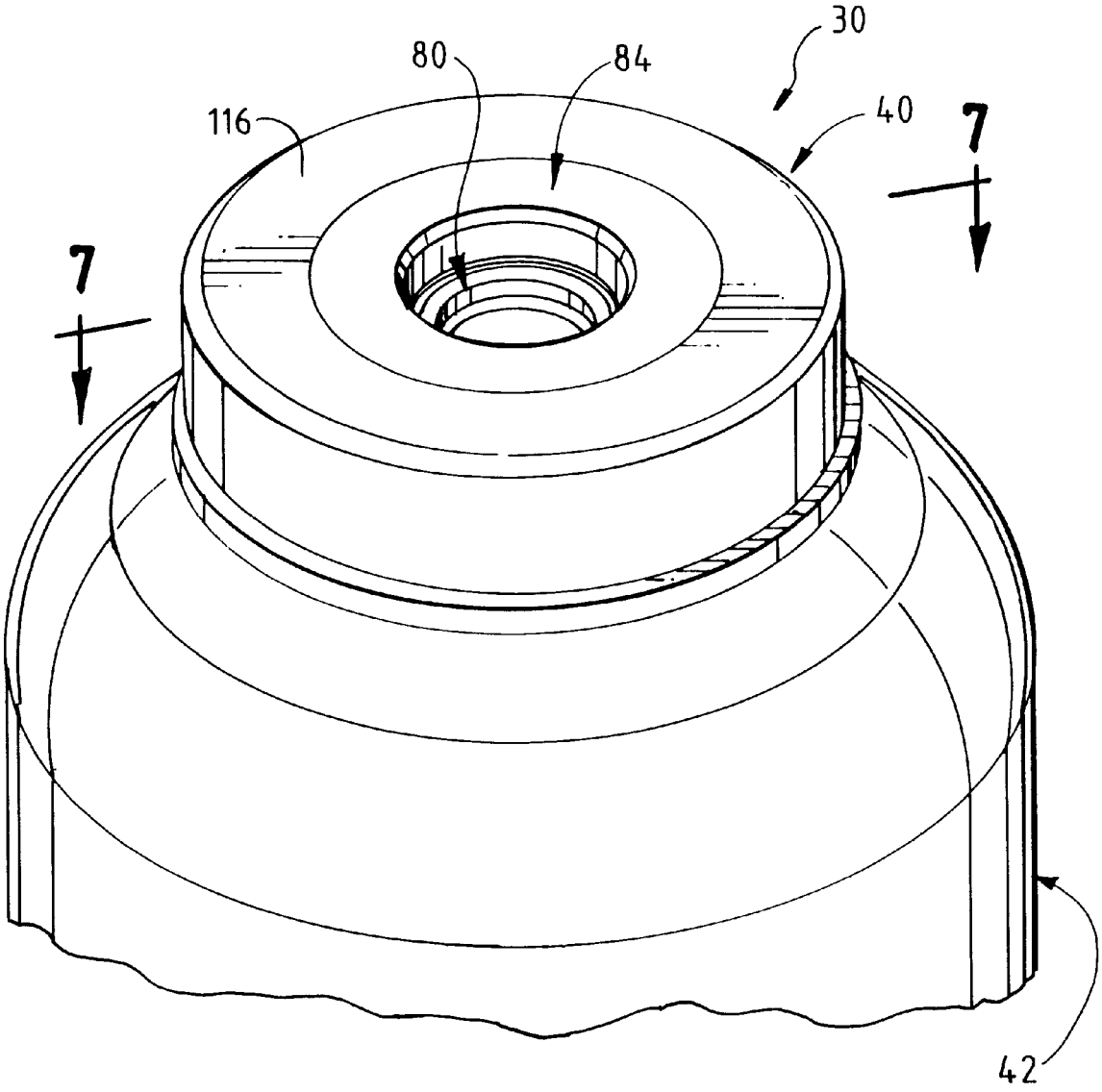
FIG. 1 is a fragmentary, perspective view of an embodiment of a container and closure dispensing system of the present invention shown with the closure in position on the container.
Figure 2:
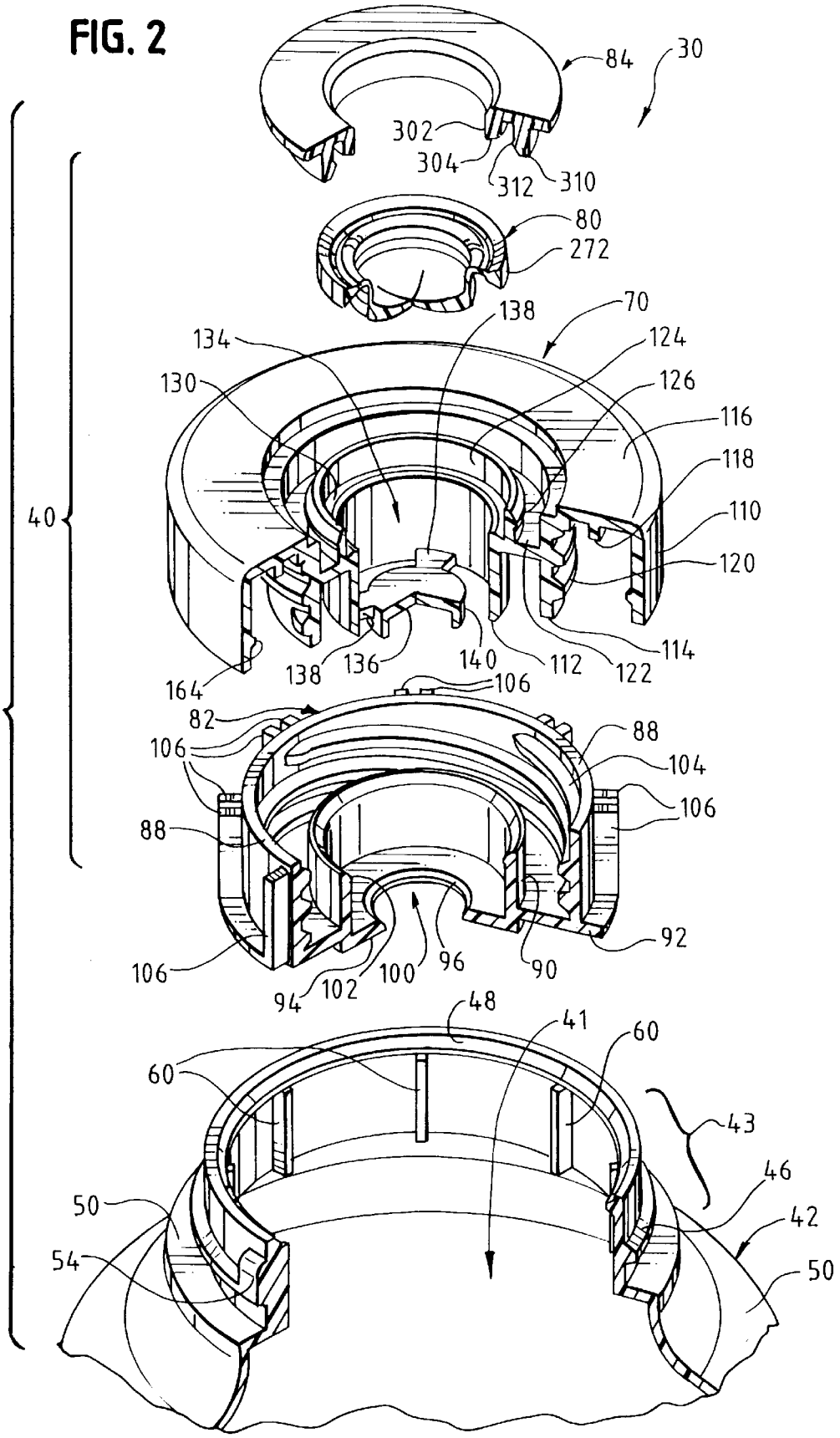
FIG. 2 is an exploded, perspective, fragmentary view of the closure and top of the container shown in FIG. 1, and FIG. 2 also shows portions of the components cut away to illustrate interior detail.

With reference to the figures, the dispensing system of the present invention is incorporated in a package represented generally in many of the figures by the reference numeral 30. The system or package 30 includes a closure 40 which is adapted to be disposed on a container 42 (FIGS. 1 and 2) which has a mouth or opening 41 formed by a neck 43 (FIG. 2). The neck 43 has a circular cross-sectional configuration with an exterior, radial retention flange 46 (FIG. 2) to hold the closure 40 on the container 42 as described in detail hereinafter. The interior of the neck 43 has an annular sealing surface or ring 48 (FIGS. 2 and 5) for sealingly engaging the closure 40 as described in detail hereinafter.

Figure 3:
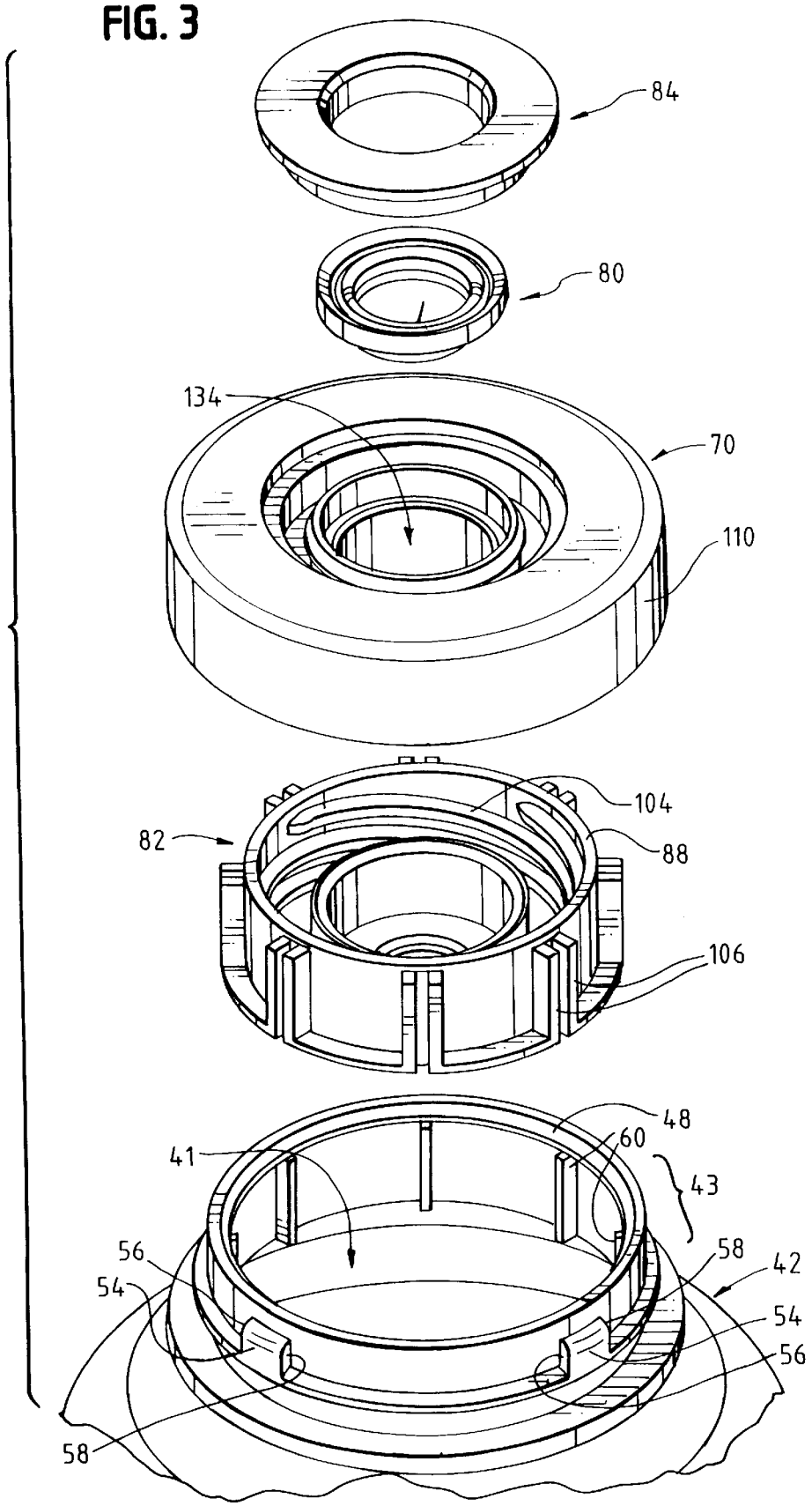
FIG. 3 is an exploded, perspective, fragmentary view of the closure and top of the container similar to FIG. 2, but in FIG. 3, portions of the components are not cut away.
Figure 4:
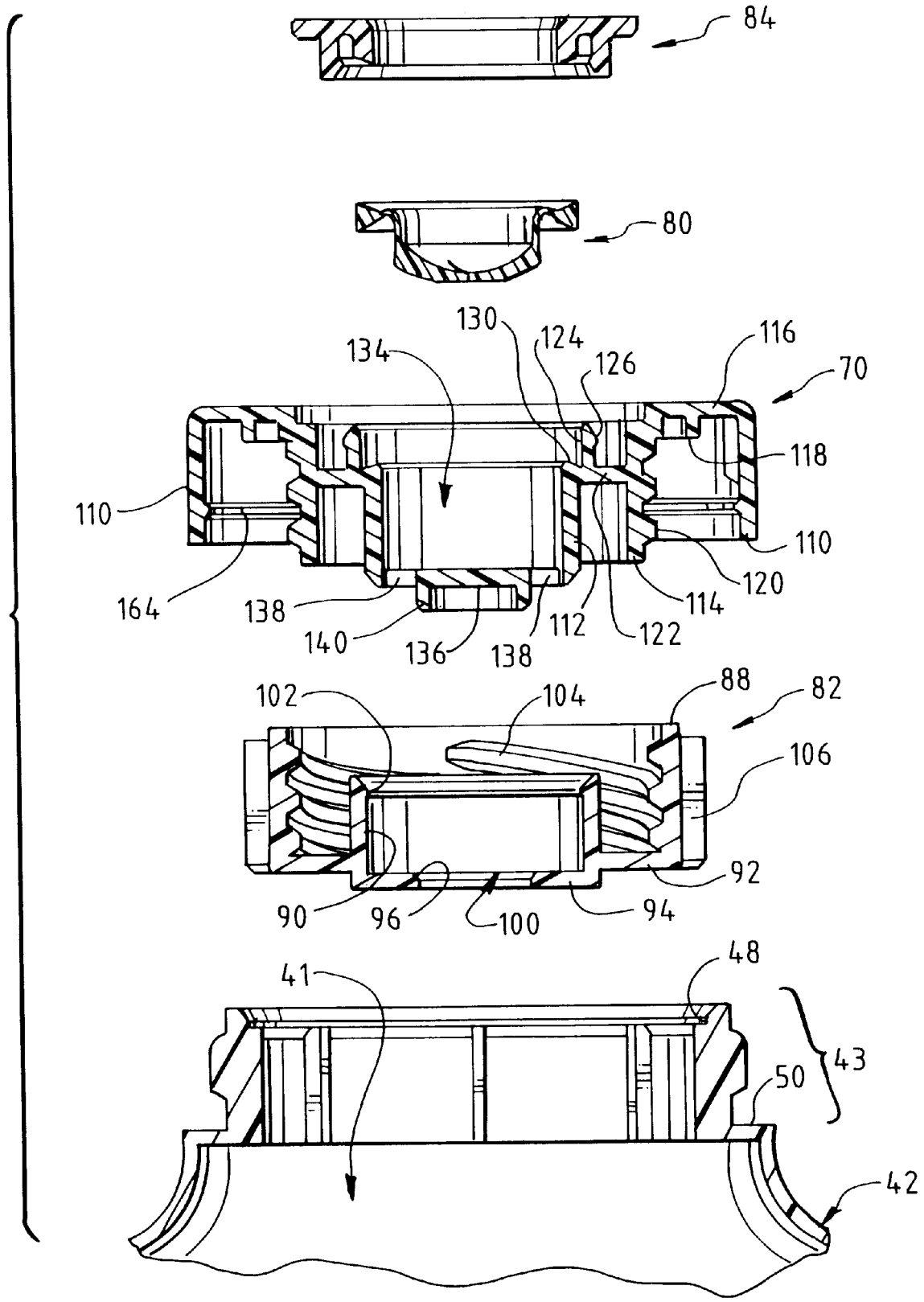
FIG. 4 is an exploded, fragmentary, side, elevational view of the components shown in FIG. 3.

The body of the container 42 is generally cylindrical, but may have another cross-sectional configuration, such as an oval cross-sectional shape, for example. The container 42 has an annular shoulder 50 (FIGS. 2 and 5) from which the neck 43 extends. Projecting outwardly from the neck 43 is an optional feature—at least one lug 54 (FIGS. 3 and 10), and preferably a plurality of lugs 54 (FIGS. 3 and 10), which each defines a first outwardly extending surface 56 (FIG. 3) that functions as a stop surface to limit the amount of opening of the closure as described in detail hereinafter. Each lug 54 also defines a second outwardly extending surface 58 (FIG. 3).

On the inside of the container neck 43 or neck finish, the container includes at least one rib 60 (FIG. 2), and preferably a plurality of vertically oriented, spaced-apart ribs 60 (FIG. 2), which function to prevent rotation of one of the components of the closure 40 as described in detail hereinafter.

The container 42 and closure 40 may be fabricated from thermoplastic materials, or other materials, compatible with the container contents. The container 42 may be stored in the orientation shown in FIG. 1 wherein the closure 40 is at the top of the container 42. The container 42 may also be normally stored in an inverted position. When stored in the inverted position, the container 42 employs the closure 40 as a support base.

The container 42 is a squeezable container having a flexible wall or walls which can be grasped by the user and compressed to increase the internal pressure within the container so as to squeeze the product out of the container when an internal shipping seal is opened inside the closure 40 (as explained in detail hereinafter). The container wall typically has sufficient, inherent resiliency so that when the squeezing forces are removed, the container wall returns to its normal, unstressed shape.

Figure 5:
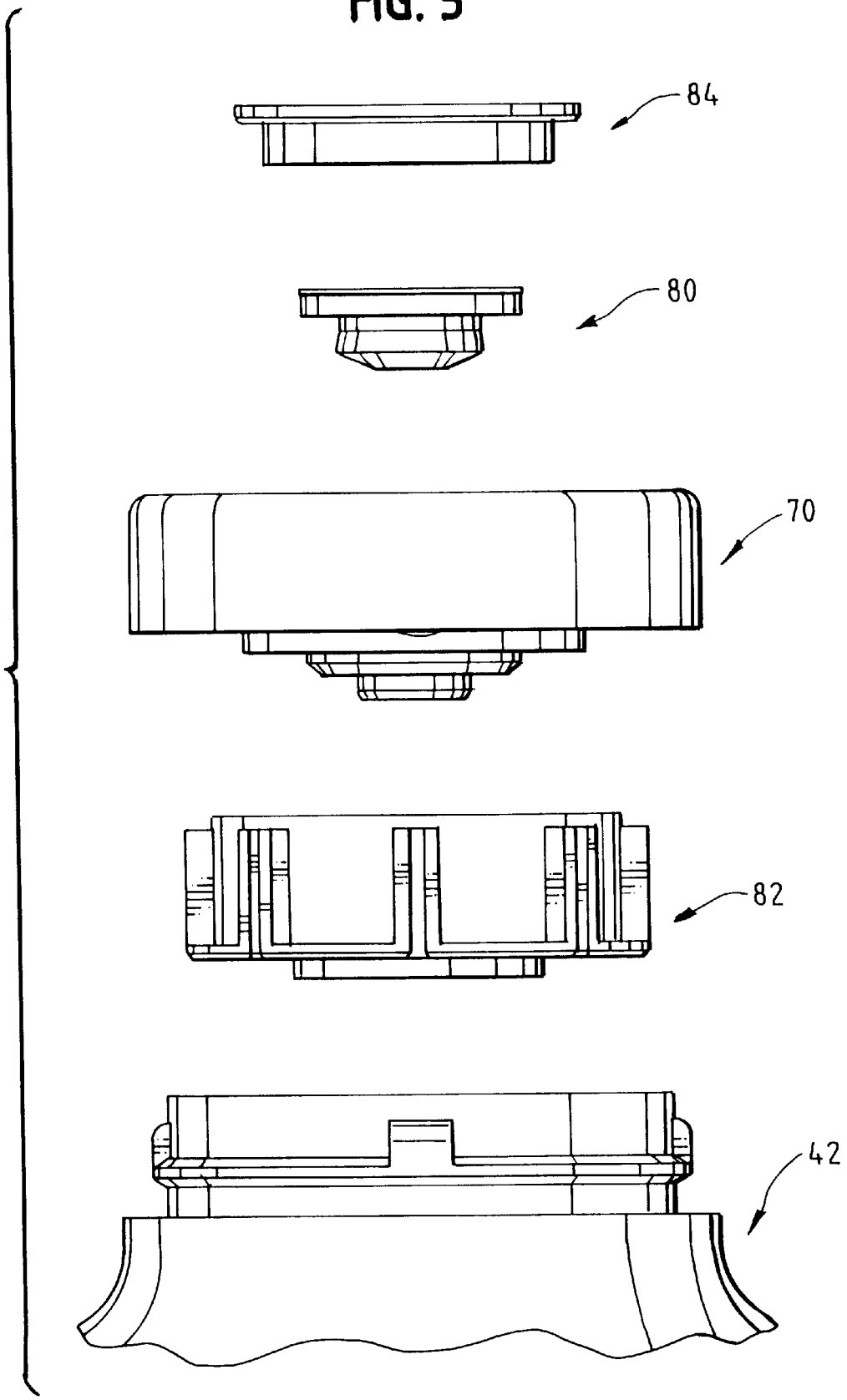
FIG. 5 is an exploded, cross-sectional view of the components shown in FIG. 4.
Figure 9:
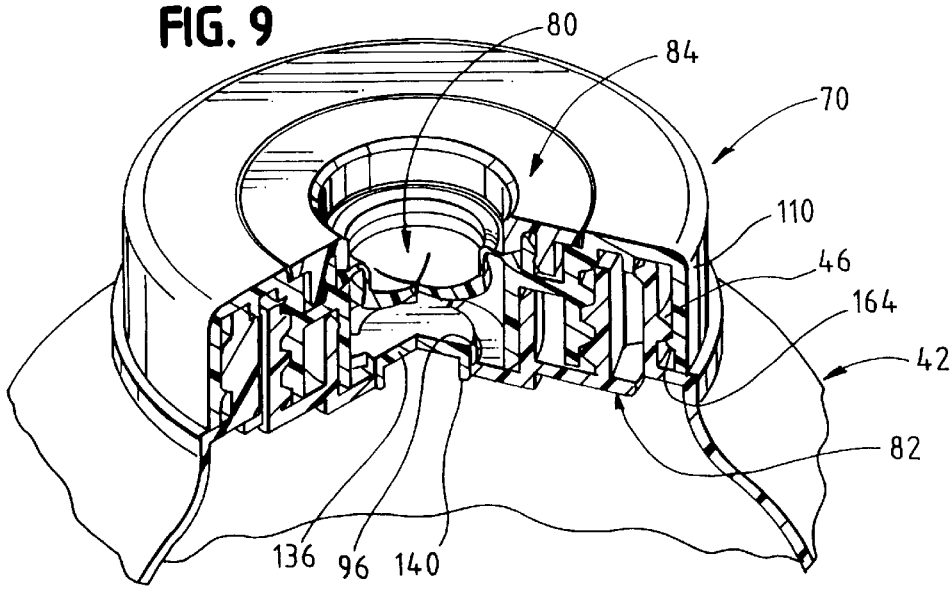
FIG. 9 is a view similar to FIG. 1, but FIG. 9 shows portions of the components cut away to illustrate interior detail with components in a fully closed condition.

As illustrated in FIG. 3, the closure 40 includes a housing or shell 70, a valve 80, an elevator 82, and a retaining ring 84. As shown in FIGS. 3, 5, and 9, the elevator 82 is adapted to be disposed within the container neck opening 41 adjacent the neck 43.

The elevator 82 is movable between (1) a fully elevated position (FIGS. 7–9) in which the dispensing system is sealed closed, and (2) a fully lowered position (FIGS. 10–12) in which the dispensing system internal seal is fully opened. As can be seen in FIG. 2, the elevator 82 includes an annular outer wall 88 and a generally annular inner wall 90 which is concentric with the generally annular outer wall 88. An annular deck 92 joins the outer wall 88 with the inner wall 90.

Extending radially inwardly from the bottom of the elevator inner wall 90 is an annular seat structure 94 defining a frustoconical sealing surface or seat 96. The seat 96 defines an inlet passage 100. The inner wall 90 may be characterized as a collar extending around, and upwardly from, the elevator seat 96 and seat structure 94. The upper end of the inner annular wall or collar 90 includes a sealing bead 102 which projects radially inwardly for sealingly engaging a portion of the housing 70 as described in detail hereinafter.

The inner surface of the elevator outer wall 88 defines a thread 104 for threadingly engaging the housing 70 in a manner described in detail hereinafter. In the preferred embodiment illustrated, the thread 104 is a quad-lead helical thread form. A single helical thread form or other multi-lead thread form may be employed.

Figure 7:
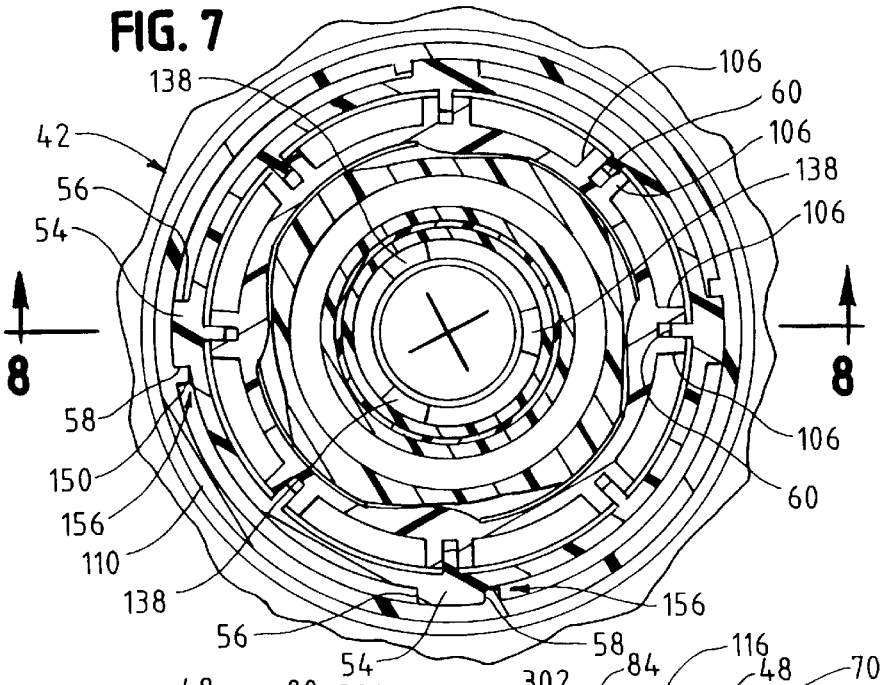
FIG. 7 is a fragmentary, cross-sectional view taken generally along the plane 7—7 in FIG. 1.

As can be seen in FIG. 2, the elevator 82 has a plurality of pairs of radially outwardly projecting, spaced-apart tabs 106. The two tabs 106 of each pair are adapted to receive between them one of the container ribs 60 (FIG. 7). Each pair of tabs 106 functions as a mating structure for matingly engaging one of the container ribs 60. The container ribs 60 thus function as a rotation restraint structure to prevent rotation of the elevator 82 relative to the container 42. The container ribs 60 and the elevator mating tabs 106, while preventing relative rotation, do permit vertical movement of the elevator 82 relative to the container 42 (between the elevator fully raised position shown in FIGS. 7–9 and the elevator fully lowered position shown in FIGS. 10–12).

Figure 8:
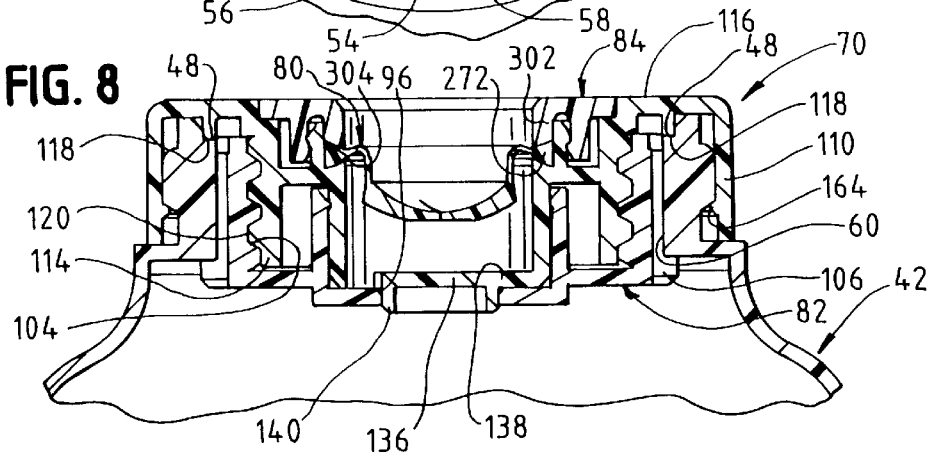
FIG. 8 is a fragmentary, cross-sectional view taken generally along the plane 8—8 in FIG. 7.

With reference to FIGS. 2 and 5, the housing 70 includes a generally annular outer wall 110, a generally annular inner wall 112, and a generally annular intermediate wall 114 between the outer wall 110 and inner wall 112. The top of the outer wall 110 and the top of the intermediate wall 114 are joined by an annular deck 116. A seal ring 118 projects downwardly from the underside of the housing deck 116 for sealingly engaging the container annular sealing surface 48 as shown in FIG. 8.

As can be seen in FIGS. 2 and 5, the housing intermediate wall 114 has a thread 120 defined on its outer surface. In the illustrated embodiment, the thread 120 is a quad-lead helical thread form adapted to threadingly engage the quad-lead helical thread 104 in the elevator 82 as shown in FIG. 8. A single helical thread form or other multi-lead thread form may be employed on the housing intermediate wall 114 with a compatible mating thread form in the elevator 82.

As can be seen in FIGS. 2 and 5, the housing 70 includes a recessed deck 122 extending radially inwardly from the intermediate wall 114 to the top of the inner wall 112. Projecting upwardly from the top of the recessed deck 122 is an annular wall 124 defining a radially outwardly projecting retention bead 126 for engaging the retaining ring 84 as described in detail hereinafter.

With reference to FIGS. 2 and 5, the upper end of the inner wall 112 of the housing 70 extends upwardly from the radially inward end of the housing recessed deck 122 to define an upwardly facing, frustoconical seating surface 130 for receiving the valve 80 as described in detail hereinafter.

As can be seen in FIGS. 2 and 5, the housing inner wall 112 may be characterized as an internal conduit which defines a dispensing passage 134 in alignment with, and communicating with, the inlet passage 100 defined by the elevator 82.

Figure 6:
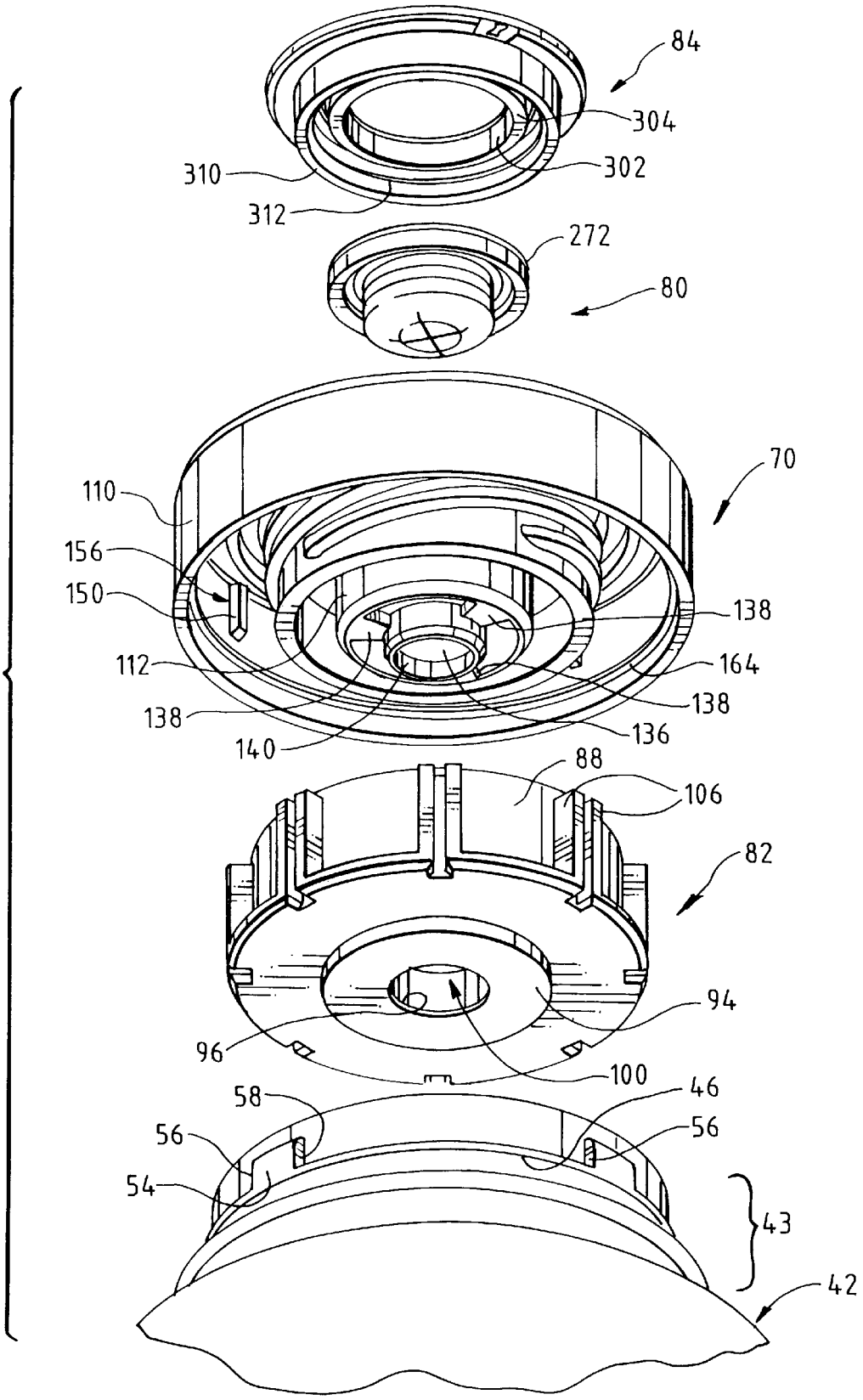
FIG. 6 is an exploded, fragmentary view similar to FIG. 3, but FIG. 6 shows the components from a perspective view of the undersides of the components.

The inlet conduit or inner wall 112 of the housing 70 supports an occlusion member which is a disk-like member 136 (FIGS. 2 and 5) connected to arms 138 extending inwardly from the inner wall 112. As can be seen in FIG. 7, there are three such arms 138. The arms 138 are equally spaced around the disk-like member 136 as can be seen in FIG. 6. The disk-like member 136 includes a downwardly extending seal ring 140 (FIGS. 2 and 6). The seal ring 140 is adapted to sealingly engage the elevator seat 96 when the elevator 92 is in the fully raised position (FIGS. 8 and 9). When the elevator 92 is in the fully raised position (FIGS. 8 and 9), the occlusion member (which includes the disk-like member 136 and the seal ring 140) completely occludes the elevator inlet passage 100 (FIG. 2) and prevents flow through the inlet passage.

Figure 10:
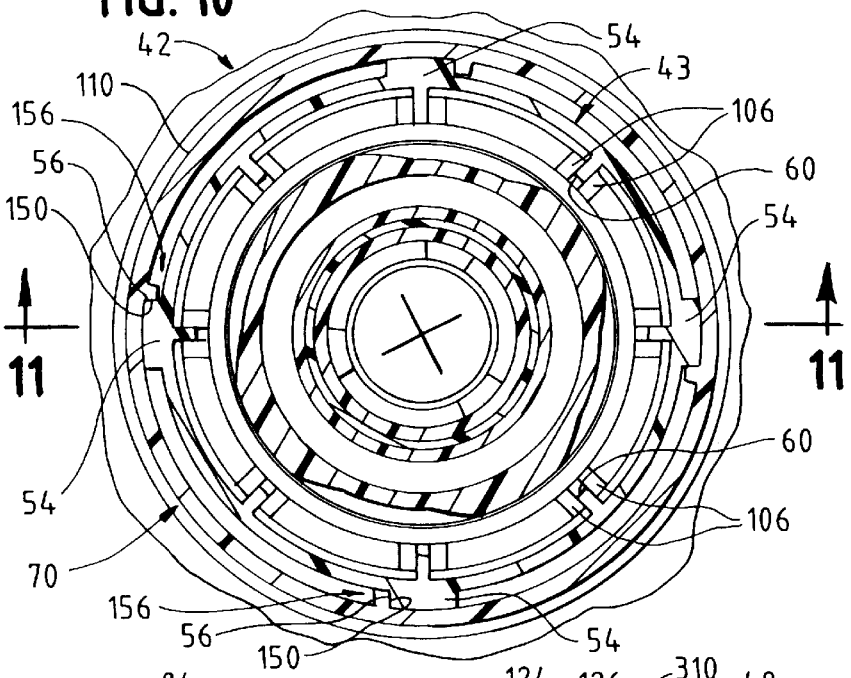
FIG. 10 is a fragmentary, cross-sectional view similar to FIG. 7, but FIG. 10 shows the components in a fully opened condition.

The elevator 82 can be moved to, and maintained at, the fully elevated position shown in FIG. 8 via the threaded engagement between the elevator 82 and the housing 70. The elevator 82 can be moved away from the fully elevated position in FIG. 8 by rotating the housing 70 in the counterclockwise direction as viewed in FIG. 9. This will cause the elevator 82 to be driven downwardly while the elevator 82 is restrained from rotation owing to the engagement of the elevator tabs 106 (FIG. 10) with the container neck ribs 60 (FIG. 10).

Rotation of the housing 70 in the clockwise direction (as viewed in FIG. 7) drives the elevator 82 upwardly toward the fully elevated position (FIG. 7). When the elevator 82 is in the fully elevated position (FIG. 7), the elevator seat 96 engages the housing occlusion member seal ring 140 to seal the system closed. This sealing engagement prevents further upward movement of the elevator 82 and prevents the housing 70 from being further rotated in the clockwise direction.

Preferably, the dispensing system includes a rotation limit system for limiting the counterclockwise rotation of the housing 70 and the resulting vertical downward movement of the elevator 82. Specifically, the rotation limit system includes at least one abutment surface 150 extending inwardly from the housing outer wall 110 (FIG. 6) for engaging an outwardly extending stop surface 56 of one of the container neck lugs 54 (FIGS. 6 and 10). In the preferred embodiment illustrated, the housing 70 includes a plurality of equally spaced ribs 156 projecting inwardly from the inside surface of the outer wall 110. Each rib 156 defines an abutment surface 150. When the housing 70 is rotated counterclockwise to a predetermined position wherein the elevator 82 has been driven downwardly to the fully lowered position (FIGS. 10–12), the inwardly extending abutment surface 150 of each rib 156 engages one of the outwardly extending stop surfaces 56 of one of the container neck lugs 54, and this prevents the housing 70 from being rotated further in the counterclockwise direction (as viewed in FIG. 10). This prevents the elevator 82 from being driven further downwardly and out of threaded engagement with the housing 70.

When the housing 70 is rotated in the clockwise direction (as viewed in FIG. 7) to raise the elevator 82 to the fully elevated position, the elevator seat 96 engages the seal ring 140 extending from the housing disk-like member 136 to prevent further upward movement of the elevator 82 and prevent the housing 70 from being rotated further in the clockwise direction. At the same time, the housing ribs 156 become positioned adjacent, or may even engage, the outwardly extending surfaces 58 of the container lugs 54 as shown in FIG. 7.

Figure 11:
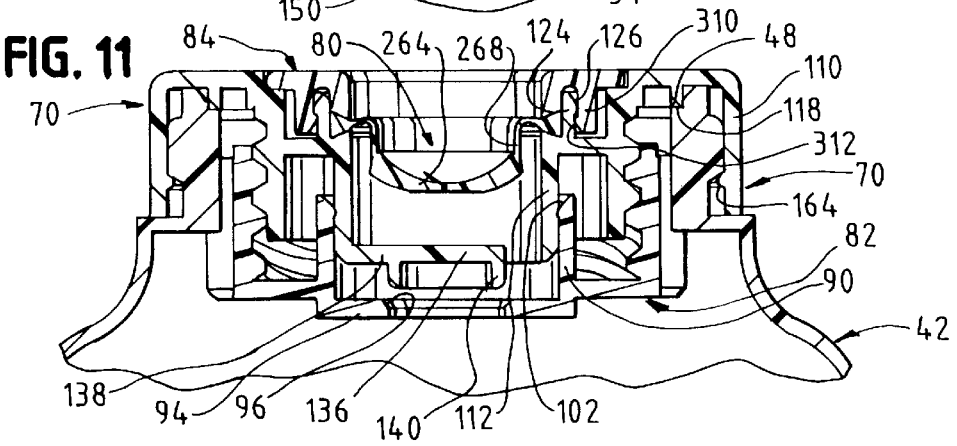
FIG. 11 is a fragmentary, cross-sectional view taken generally along the plane 11—11 in FIG. 10.
Figure 12:
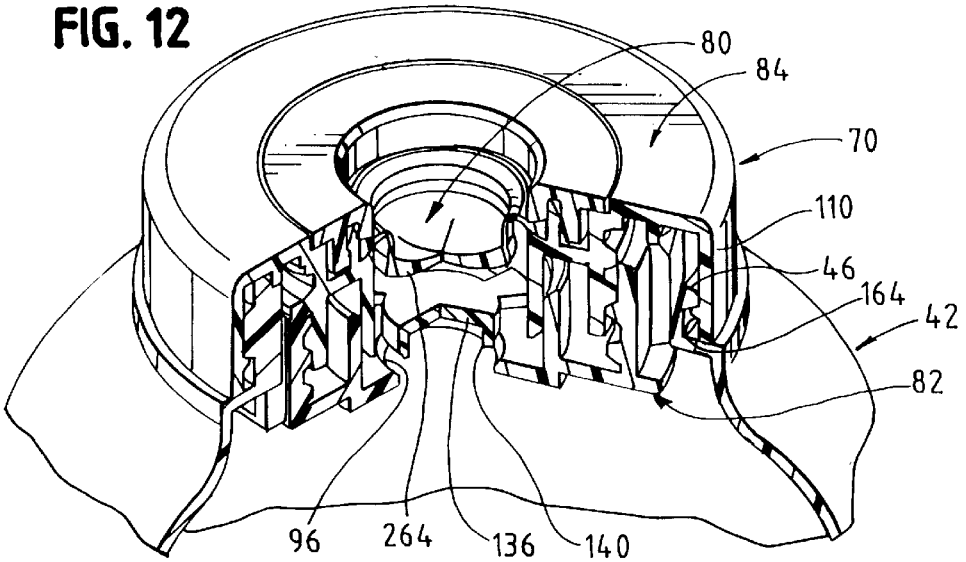
FIG. 12 is a view similar to FIG. 9, but FIG. 12 shows the components in the fully opened condition.

The housing 70 is retained on the container neck 43 in a manner that accommodates rotation of the housing 70 relative to the container 42. To this end, the housing outer wall 110 includes an inwardly extending bead 164 (FIGS. 2, 6, 8, 9, 11, and 12). The bead 164 engages the lower surface of the container neck retention flange 46 as shown in FIGS. 9 and 12. The upper surface of the container neck retention flange 46 is curved downwardly, and the lower surface of the housing bead 164 is curved upwardly to accommodate initial assembly when the housing 70 is pushed downwardly onto the container neck 43. The components have sufficient flexibility to accommodate a temporary deflection of the components so that the bead 164 is forced downwardly past the flange 46 to establish a snap-fit engagement which permits rotation of the housing 70 relative to the container 42 while retaining the closure 70 and container 42 in an assembled condition with the elevator 82, valve 80, and valve-retaining ring 84 mounted to the housing 70.

The preferred embodiment of the valve 80 is designed to be effectively clamped in position on the closure housing seat 130 (FIGS. 2 and 5) by the retaining ring 84 (FIGS. 2 and 5). In the preferred form of the valve 80 illustrated, the valve 80 is of a known design employing a flexible, resilient material, which can open to dispense fluid. The valve 80 may be fabricated from thermosetting elastomeric materials such as silicone, natural rubber, and the like. It is also contemplated that the valve 80 may be fabricated from thermoplastic elastomers based upon materials such as thermoplastic propylene, ethylene, urethane, and styrene, including their halogenated counterparts.

A valve which is similar to, and functionally analogous to, valve 80 is disclosed in the U.S. Pat. No. 5,439,143. However, the valve 80 has a peripheral flange structure (described in detail hereinafter) which differs from the flange structure of the valve shown in the U.S. Pat. No. 5,439,143. The description of the valve disclosed in the U.S. Pat. No. 5,439,143 is incorporated herein by reference to the extent pertinent and to the extent not inconsistent herewith.

Figure 13:
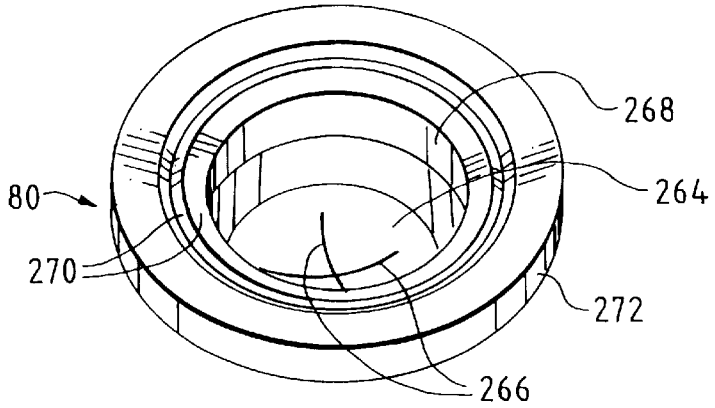
FIG. 13 is an enlarged, perspective view of the valve shown in FIGS. 1–3.
Figure 14:
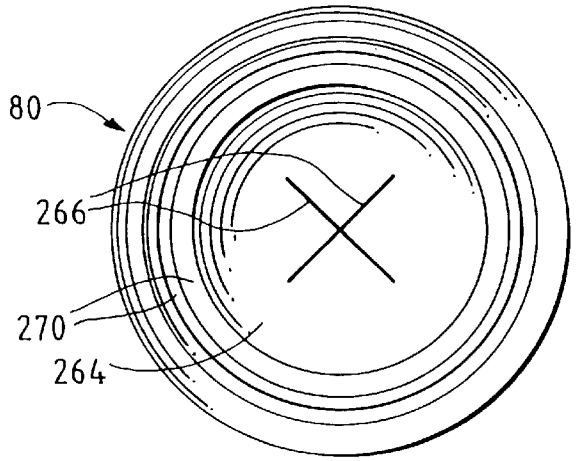
FIG. 14 is a top plan view of the valve shown in FIG. 13.
Figure 15:
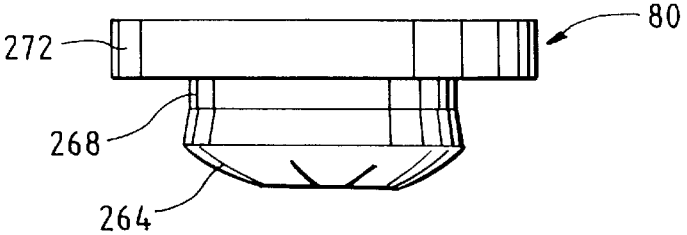
FIG. 15 is a side elevational view of the valve shown in FIGS. 13 and 14.

As illustrated in FIGS. 13–15, the valve 80 includes a flexible, central portion, wall, or face 264 which has a concave configuration (when viewed from the exterior) and which defines two, mutually perpendicular, intersecting, dispensing slits 266 of equal length. The intersecting slits 266 define four, generally sector-shaped, flaps or petals in the concave, central wall 264. The flaps open outwardly from the intersection point of the slits 266, in response to increasing container pressure of sufficient magnitude, in the well-known manner described in the U.S. Pat. No. 5,439,143.

The valve 80 includes a skirt 268 (FIG. 15) which extends outwardly from the valve central wall or face 264. At the outer (upper) end of the skirt 268 there is a thin, annular flange 270 which extends peripherally from the skirt 268 in an angled orientation. The thin flange 270 terminates in an enlarged, much thicker, peripheral flange 272 which has a generally dovetail shaped transverse cross section.

To accommodate the seating of the valve 80 in the closure housing 70, the attachment region or seat 130 of the closure housing 70 has the same angle as the angle of the valve flange dovetail configuration. The bottom surface of the valve flange 272 is disposed on the closure housing valve seat 130.

The upper surface of the valve flange 272 is clamped by the retaining ring 84. As illustrated in FIGS. 2 and 6, the retaining ring 84 includes an inner, annular clamping wall 302 having a downwardly angled bottom end clamping surface 304. When the retaining ring 84 is mounted on the closure housing 70, the spacing between the clamping surface 304 of the retaining ring 84 and the closure housing valve seat 130 (FIG. 8) increases with increasing radial distance from the center of the valve 80. Such a configuration defines an annular cavity with a transverse cross section having a dove-tail shape which generally conforms to the dove-tail shape of the valve flange 272.

The retaining ring 80 includes an outer annular wall 310 (FIGS. 2 and 6) with a radially inwardly extending bead 312. When the retaining ring 84 is mounted in the closure housing 70 (FIG. 11), the retaining bead 312 (FIG. 2) is adapted to be received under the bead 126 of the housing annular wall 124 (FIG. 2) in a snap-fit engagement as shown in FIG. 11. This arrangement securely clamps and holds the valve 80 without requiring special internal support structures or bearing members adjacent the interior surface of the valve cylindrical skirt 268. This permits the region adjacent the interior surface of the valve cylindrical skirt 268 to be substantially open, free, and clear so as to accommodate movement of the valve skirt 268.

If desired, the valve 80 could be retained in the closure housing 70 without the retaining ring 84. For example, the valve 80 could be bonded to the closure housing 70 with adhesive or could be directly molded onto the closure housing 70 so as to create a weld defined by interface solidification of melted portions of the materials. The valve 80 could be molded with the slits 266. Alternatively, the valve slits 266 could be subsequently cut into the wall or face 264 of the valve 80 by suitable conventional techniques.

When the valve 80 is properly mounted within the closure housing 70 as illustrated in FIGS. 11 and 12, the central wall or face 264 of the valve 80 lies recessed within the closure housing 70. However, when the container 42 is squeezed to dispense the contents through the valve 80 (as described in detail in the U.S. Pat. No. 5,439,143), then the valve central wall or face 264 is forced outwardly from its recessed position toward the end of the housing 70.

Figure 16:
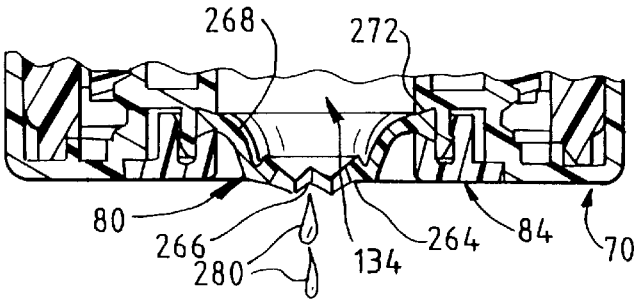
FIG. 16 is a fragmentary, cross-sectional view similar to FIG. 11, but FIG. 16 shows the container and closure in an inverted position and dispensing product through the valve.

In order to dispense product from the container 42, the occlusion member seal ring 140 is moved to the opened position by rotating the closure housing 70 on the container 42 to drive the elevator 82 downwardly to the lowered position (FIGS. 10–12). In use, the container 42 is then typically inverted and squeezed to increase the pressure within the container 42 above the ambient exterior atmospheric pressure. This forces the product within the container toward the valve 80 and forces the valve 80 from the recessed or retracted position (illustrated in FIGS. 11 and 12) toward the outwardly extending position (FIG. 16). The outward displacement of the central face 264 of the valve 80 is accommodated by the relatively, thin, flexible, skirt 268. The skirt 268 moves from an inwardly projecting, rest position to an outwardly displaced, pressurized position, and this occurs by the skirt 268 "rolling" along itself outwardly toward the outside of the housing 70 (toward the position shown in FIG. 16). However, the valve 80 does not open (i.e., the slits 266 do not open) until the valve central face 264 has moved substantially all the way to a fully extended position in or beyond the dispensing passage 134. Indeed, as the valve central wall 264 initially begins to move outwardly, the valve central wall 264 is initially subjected to radially inwardly directed compression forces which tend to further resist opening of the slits 266. Also, the valve central wall 264 generally retains its inwardly concave configuration as it moves outwardly and even after it reaches the fully extended position. However, when the internal pressure becomes sufficiently high after the valve central wall 264 has moved outwardly to the fully extended position, then the slits 266 of the valve 80 begin to open to dispense product (FIG. 16). The product is then expelled or discharged through the open slits 266. For illustrative purposes, FIG. 16 shows drops 280 of a liquid product being discharged.

When the contents of the container 42 are dispensed through the dispensing passage 134 defined in the center of the housing 70 (FIG. 2), the contents flow past the open occlusion member disk 136 and seal ring 140, between the arms 138, and into the region below the valve 80 in the dispensing passage 134. The container contents can then be dispensed through the valve 80 if the valve is forced open by sufficient internal pressure generated by squeezing the container as described above (and as described in detail in U.S. Pat. No. 5,429,143).

When the closure 40 is manufactured and initially assembled on the container 42, the closure 40 is typically initially arranged with the elevator 82 in the raised, closed condition (FIGS. 7–9). This is also the condition in which the container 42 can be conveniently carried in a user's suitcase while the user is travelling. In the closed condition, any increased pressure in the container will be prevented from acting on the valve 80 because of the occlusion of the dispensing passage by the closed occlusion member disk 136 and seal ring 140 (FIGS. 7–9).

The closure 40 is initially assembled by the manufacturer. The manufacturer first places the valve 80 on the valve seat 130 of the closure housing 70. Then the retaining ring 84 is snap-fit into place on top of the valve flange 272 to clamp the valve 80 in the housing 70.

Next, the elevator 82 is assembled by effecting engagement between the elevator quad-lead thread 104 and the housing quad-thread 120. The elevator 82 is rotated into the closure housing 70 until the upward movement of the elevator 82 into the housing 70 terminates when the elevator seat 96 engages the seal ring 140 on the housing disk-like member 136. The elevator 82 and housing 70 are then in the fully closed position.

Next, the assembled closure 40 is mounted to the container 42. To this end, the vertical slots or spaces defined between the ribs 106 of the elevator 82 are aligned relative to the container vertical ribs 60 so that each container rib 60 can be received between a pair of the elevator ribs 106. In addition, the container stop lug stop surfaces 58 are aligned to be adjacent to, and abut, the ribs 156 projecting inwardly from the outer wall 110 of the housing 70.

After the parts are aligned, relative movement is effected between the container (which would have been previously filled with product) and the assembled closure 40 so as to mount the closure 40 on the container neck 43. To this end, an axial force is applied to force the closure housing outer wall bead 164 past the container retention flange 46 (FIG. 9) to effect a snap-fit engagement.

It will be appreciated when the closure 40 is operated to open or close the internal dispensing passage 134 in the housing 70, the bead 102 on the elevator inner wall or collar 90 engages the exterior cylindrical surface of the housing inner wall or conduit 112 as shown in FIG. 11 to effect a dynamic plug seal engagement and prevent leakage of the product out of the dispensing passage.

Further, it will also be appreciated that the product cannot leak out of the container 42 past the housing outer wall 110 owing to the engagement between the housing seal ring 118 and the container neck annular sealing surface 48 as shown in FIGS. 8 and 11.

It will be appreciated that, in some applications, it may be desirable to provide only one stop lug 54 on the container 42 and only one abutment rib 60 on the housing 70. It will also be appreciated that the illustrated structure of an abutment rib 60 per se and/or the illustrated structure of a stop lug 54 per se need not be provided. Some other configuration may be employed to define an appropriate outwardly extending stop surface equivalent to the container lug stop surface 56 (FIG. 6), and some other configuration may be provided to define an appropriate abutment surface equivalent to the abutment surfaces 150 defined by the closure housing ribs 156.

It will also be appreciated that the elevator rotation restraint system may be provided by structures having configurations that differ from the structures of the elevator tabs 106 and mating container neck ribs 60 (FIGS. 2 and 7), but which provide functional equivalency.

It will be appreciated that the preferred embodiment of the dispensing structure of the present invention provides a system for covering an opening to a container with a self-closing valve. Further, the system includes components which are movable between (1) a closed position wherein the valve is sealed from the container, and (2) an open position wherein the valve is in communication with the container to accommodate dispensing of the container contents.

The dispensing system of the present invention can be readily operated between the open and closed conditions, and such operation does not effect upward or downward movement of the closure housing 70 which is mounted to the top of the container. This minimizes the likelihood that a foreign object or dirt may become lodged between the bottom of the closure housing 70 and the container 42. This also provides a more aesthetically pleasing package which maintains the same overall height regardless of whether it is open or closed. Because the internal elevator 82 moves vertically within the package, and because no exterior part of the package changes in elevation, the user does not have to accommodate any change in package height during use or storage of the package. Because the internal elevator 82 moves downwardly into the container, the overall height of the package can be minimized by the manufacturer.

The preferred form of the system of the present invention is aesthetically pleasing and has no lid which could interfere with the dispensing of the product from the container. Additionally, because there is no lid, the user's view of the dispensing process is not obscured.

If desired, a releasable, pull-away label or tab (not illustrated) could be sealed to the top of the closure (e.g., to the top of the retaining ring 84) over the recessed valve 80 to protect the valve and prevent contaminants from contacting the valve 80 during shipping, storage, and handling.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing system comprising:

a container having an opening to the container interior; and a closure including:

(A) an elevator that (1) is disposed within said container opening, (2) is movable between a fully elevated position and a fully lowered position while restrained by said container from rotating, (3) has a seat defining an inlet passage, and (4) has a thread;

(B) a rotatable housing that (1) is mounted on said container at said opening, (2) has a thread engaged with said elevator thread, (3) has a dispensing passage, and (4) has an occlusion member that (i) sealingly engages said elevator seat and prevents flow through said inlet passage when said elevator is in said fully elevated position, and (ii) permits flow when said elevator is moved away from said fully elevated position; and (C) a dispensing valve that is sealingly secured across said dispensing passage and that opens to permit flow therethrough.

2. The dispensing system in accordance with claim 1 in which said container has at least one outwardly extending stop surface; and said closure housing includes at least one inwardly extending abutment surface for engaging said container stop surface at a predetermined rotational position of said closure housing relative to said container.

3. The dispensing system in accordance with claim 1 in which said container includes at least one rotation restraint structure; and said elevator includes at least one mating structure for engaging said container rotation restraint structure to prevent rotation of said elevator relative to said container.

4. The dispensing system in accordance with claim 1 in which said elevator includes a collar extending around, and upwardly from, the periphery of said elevator seat; and said housing includes an internal conduit defining said dispensing passage and sealingly engaging said elevator collar.

5. The dispensing system in accordance with claim 4 in which said collar includes a sealing bead projecting radially inwardly to sealingly engage said housing conduit.

6. The dispensing system in accordance with claim 1 in which said valve has an generally annular flange;

said container includes a generally annular valve support surface on which said valve flange is received; and said closure includes a retention ring snap-fit into said housing for engaging a portion of said valve flange and clamping said valve in said housing.

7. The dispensing system in accordance with claim 1 in which said housing includes (1) a generally annular outer wall, (2) a generally annular inner wall functioning as a conduit for defining said dispensing passage, and (3) a generally annular intermediate wall between said inner wall and said outer wall, said intermediate wall including said housing thread; and said elevator including (1) a generally annular outer wall defining said elevator thread, and (2) a generally annular inner wall in the form of a collar extending around, and upwardly from, said elevator seat.

8. The dispensing system in accordance with claim 1 in which said container includes at least one generally vertically oriented rib projecting generally radially inwardly; and said elevator has at least one pair of radially outwardly projecting, spaced-apart tabs for receiving between them said container rib to prevent rotation of said elevator relative to said container.

9. The dispensing system in accordance with claim 1 in which said housing includes an annular inner wall functioning as a conduit for defining said dispensing passage; and said closure occlusion member is a disk-like member that is supported by arms extending inwardly from said housing annular inner wall, said disk-like member including a downwardly extending seal ring for engaging said elevator seat.

10. The dispensing system in accordance with claim 1 in which each said thread comprises at least one helical thread.

11. The dispensing system in accordance with claim 1 in which said housing thread is a male thread and said elevator thread is a female thread.

12. The dispensing system in accordance with claim 1 in which said container defines a radial retention flange; and said housing includes an inwardly extending bead for engaging one side of said container radial retention flange to prevent said housing from being lifted off of said container.

13. The dispensing system in accordance with claim 1 in which said container includes an annular sealing surface at said opening;

said closure housing includes an annular deck; and said closure housing includes a seal ring projecting downwardly from said deck for sealingly engaging said container annular sealing surface at said opening.

14. The dispensing system in accordance with claim 1 in which said dispensing valve has at least one self-sealing slit that opens to permit flow therethrough in response to increased pressure on the side of the valve facing the interior of the container.

15. A dispensing system comprising:

a container having (1) an opening to the container interior, (2) at least one generally vertically oriented rib projecting generally radially inwardly, and (3) at least one outwardly extending stop surface; and a closure including:

(A) an elevator that (1) is disposed within said container opening, (2) is movable between a fully elevated position and a fully lowered position while restrained by said container from rotating, (3) has a seat defining an inlet passage, (4) has a thread, (5) has at least one pair of radially outwardly projecting, spaced-apart tabs for receiving between them said container rib to prevent rotation of said elevator relative to said container, and (6) has at least one inwardly extending abutment surface for engaging said container stop surface at a predetermined rotational position of said closure housing relative to said container;

(B) a rotatable housing that (1) is mounted on said container at said opening, (2) has a thread engaged with said elevator thread, (3) has a dispensing passage, and (4) has an occlusion member that (i) sealingly engages said elevator seat and prevents flow through said inlet passage when said elevator is in said fully elevated position, and (ii) permits flow when said elevator is moved away from said fully elevated position; and (C) a dispensing valve that is sealingly secured across said dispensing passage and that opens to permit flow therethrough.

16. The dispensing system in accordance with claim 15 in which said elevator includes a collar extending around, and upwardly from, the periphery of said elevator seat; and said housing includes an internal conduit defining said dispensing passage and sealingly engaging said elevator collar.

17. The dispensing system in accordance with claim 15 in which said housing includes (1) a generally annular outer wall, (2) a generally annular inner wall functioning as a conduit for defining said dispensing passage, and (3) a generally annular intermediate wall between said inner wall and said outer wall, said intermediate wall including said housing thread; and said elevator including (1) a generally annular outer wall defining said elevator thread, and (2) a generally annular inner wall in the form of a collar extending around, and upwardly from, said elevator seat.

18. The dispensing system in accordance with claim 15 in which said housing includes an annular inner wall functioning as a conduit for defining said dispensing passage; and said closure occlusion member is a disk-like member that is supported by arms extending inwardly from said housing annular inner wall, said disk-like member including a downwardly extending seal ring for engaging said elevator seat.

19. The dispensing system in accordance with claim 15 in which said housing thread is a helical male thread; and said elevator thread is a helical female thread.

20. The dispensing system in accordance with claim 15 in which said container includes an annular sealing surface at said opening;

said closure housing includes an annular deck; and said closure housing includes a seal ring projecting downwardly from said deck for sealingly engaging said container annular sealing surface at said opening.

* * * * *